US006820958B2

(12) United States Patent
Miyakoshi

(10) Patent No.: US 6,820,958 B2
(45) Date of Patent: Nov. 23, 2004

(54) METHOD FOR CONTROLLING THE DRIVE ENERGY OF AN INK JET PRINT APPARATUS AND THE INK JET PRINT APPARATUS

(75) Inventor: Toshimori Miyakoshi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/903,610

(22) Filed: Jul. 13, 2001

(65) Prior Publication Data

US 2002/0024547 A1 Feb. 28, 2002

(30) Foreign Application Priority Data

Jul. 17, 2000 (JP) ..... 2000-216498

(51) Int. Cl.[7] ..... B41J 29/38
(52) U.S. Cl. ..... 347/17; 347/11; 347/10
(58) Field of Search ..... 347/14, 60, 11, 347/17, 9

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,608,577 A | | 8/1986 | Hori | 346/140 |
| 4,723,129 A | | 2/1988 | Endo et al. | 346/1.1 |
| 4,740,796 A | | 4/1988 | Endo et al. | 346/1.1 |
| 5,576,745 A | * | 11/1996 | Matsubara | 347/14 |
| 5,751,302 A | * | 5/1998 | Rezanka | 347/9 |
| 6,168,251 B1 | | 1/2001 | Imanaka et al. | 347/9 |

FOREIGN PATENT DOCUMENTS

| | | |
|---|---|---|
| EP | 0 569 291 A1 * | 11/1993 |
| JP | 54-56847 | 5/1979 |
| JP | 59-123670 | 7/1984 |
| JP | 59-138461 | 8/1984 |
| JP | 60-71260 | 4/1985 |
| JP | 6-320732 | 11/1994 |

* cited by examiner

*Primary Examiner*—Hai Pham
*Assistant Examiner*—Lam S. Nguyen
(74) *Attorney, Agent, or Firm*—Fitzpatrick, Cella, Harper & Scinto

(57) ABSTRACT

An optimum drive energy for a print head is supplied over an extended period of time to provide consistently good image quality without troublesome operation by the user. Temperature of the print head is monitored while varying the drive energy. A threshold value of drive energy required for ink ejection is judged using the drive energy and temperature data. An optimum drive condition is determined on the basis of the threshold value and, when the determined drive condition is different from drive condition information stored in the ink jet print head, the drive energy supplied to the ink jet print head is changed.

16 Claims, 9 Drawing Sheets

START
S1'
VOLTAGE IS SET AT VoP
S2
SUPPLY START PULSE WIDTH PW IS DETERMINED FROM EEPROM INFORMATION
S3
HEAD IS DRIVEN BY OPTIONAL PATTERN FOR PREDETERMINED PERIOD
S4
HEAD TEMPERATURE T IS OBTAINED AND STORED IMMEDIATELY AFTER DRIVE
S5
PULSE WIDTH Pw IS DECREASED BY PREDETERMINED VALUE
S6
IS HEAD DRIVEN MORE THAN TWO TIMES?
NO
YES

METHOD FOR CONTROLLING THE DRIVE ENERGY OF AN INK JET PRINT APPARATUS AND THE INK JET PRINT APPARATUS

This application is based on Patent Application No. 2000-216498 filed Jul. 17, 2000 in Japan, the content of which is incorporated hereinto by reference.

BACKGROUND OF THE INVENTION

1. Field of the Invention

The present invention relates to a method for controlling the drive energy of an ink jet print head for ejecting an ink from an ejection opening utilizing growth and collapse of a bubble generated in the ink by driving a heat generating resistor element for performing printing and to the ink jet print apparatus.

2. Description of the Related Art

The ink jet print head forms an ink ejection droplet by a variety of methods and causes the ink to adhere to a printing medium such as print paper thereby performing printing. Above all, an ink jet print head of a type which utilizes thermal energy for generating film boiling in the ink for ejecting the ink can be easily manufactured to have a high-density liquid passage arrangement (ejection opening arrangement) by forming an electrothermal transducer (heat generation element) film-formed on the substrate, electrodes, liquid-path wall, top plate and the like, through semiconductor production processes such as etching, vapor deposition, sputtering and the like. Therefore, a high-density multi-nozzle structure can be easily realized, and the ink jet print head has an outstanding characteristic that a high-resolution, high-quality image can be obtained at high speed.

However, the point to be considered in the ink jet print apparatus is applied energy to each heat generation element of the ink jet print head. When the applied energy to each heat generation element is low, film boiling phenomenon of ink tends to become unstable due to energy shortage which changes ejection speed and direction as well as ejection amount of ink resulting in a dot mis-alignment, diminished dot size, slight touching and other deterioration of print image quality. On the contrary, when the applied energy to the ink jet print head is high, a mechanical stress may be exerted on the electrothermal transducer due to excessive thermal energy, resulting in a change of film quality, generating deteriorated ink ejection as described above which sometimes leads to a damage of the ink jet print head.

Then, in order to apply an appropriate drive energy to the ink jet print head, generally, the ink ejection condition or print condition on the printing medium is observed while changing applied voltage or pulse width to the ink jet print head to measure a threshold voltage or pulse width of ejection of each ink jet print head, and the measured value is multiplied with a margin value K determined by a separate experiment so that an optimum drive condition is set.

Further, this optimum drive condition is of course varied with the shape and construction of the electrothermal transducer, ink type and the like. However, even with an ink jet print head of the same type, the optimum drive condition may be varied with film thickness variation, film thickness distribution and the like in the production process.

Japanese Patent Laid-open Publication No. 6-320732 provides memory means such as an EEPROM at the ink jet print head side in which the previously measured optimum drive condition of the ink jet print head is stored so that the stored data is retrieved to the ink jet print apparatus side to perform optimum ejection drive control for each print head.

However, like the above conventional art, even when the memory means is provided in the ink jet print head and the memory means is stored with the optimum drive condition of the print head, because the optimum drive condition is just one stored at the initial condition, the actual optimum drive condition may change as the ink jet print head is used for an extended time.

This is conjectured as due to the fact that while repeating film boiling phenomena by rapid heating of the ink, the dyestuff component and the like contained in the ink are piled up as a scorch on the electrothermal transducer, the surface film of the electrothermal transducer is corroded by a component (such as a chelating agent) contained in the ink, or a repeated thermal stress is exerted on the electrothermal transducer, so that the structure or film quality of each layer constituting the electrothermal transducer change, resulting in varied resistance or thermal conductivity.

However, since, such a phenomenon does not always occur periodically, but the degree of change is different according to various conditions such as operation environment and operation frequency of the ink jet print apparatus, it is very difficult to take a measure by anticipation. For this purpose, it is considered that the ink jet print apparatus is provided with functions adjustable by the user, however, this is not user-friendly and is not always adjusted by the user.

Accomplished under such circumstances, an object of the present invention is to provide a method for controlling a drive energy of an ink jet print apparatus which is capable of continuously applying an optimum drive energy to a print head over an extended period of time without troublesome operation by the user and provide the ink jet print apparatus.

SUMMARY OF THE INVENTION

An aspect of the present invention is a method for controlling the drive energy of an ink jet print apparatus for ejecting ink from an ink jet print head to a printing medium by driving a print element. The method comprises the following five steps. The first step is a step for supplying a plurality of different drive energies successively to the ink jet print head. The second step is a step for monitoring temperature of the ink jet print head according to the supply of each drive energy. The third step is a step for judging a threshold drive energy required for ink ejection of the ink jet print head using a value for the supplied drive energy and a value for the monitored temperature. The fourth step is a step for determining a drive condition for ejecting ink on the basis of the threshold drive energy. And the fifth step is a step for driving the print element on the basis of the determined drive condition.

Further, in another aspect of the present invention, in the fifth step, when the determined drive condition is different from drive condition information stored in the ink jet print head, drive condition information stored in the ink jet print head is updated with the determined drive condition data.

Another aspect of the present invention is a method for controlling the drive energy of an ink jet print apparatus wherein a print element is driven to eject an ink from an ink jet print head to a printing medium for performing printing. The method comprises the following four steps. The first step is a step for supplying a plurality of different drive energies successively to said ink jet print head. The second step is a step for monitoring temperature of said ink jet print head according to the supply of each said drive energy. The third step is a step for determining a drive condition for ejecting ink using a value for said supplied drive energy and a value for said monitored temperature. And the fourth step is a step for driving said print element on the basis of said determined drive condition.

With this construction, since the ink jet print head is provided with the optimum drive energy continuously over the service life of the ink jet print head, it is possible to prevent inferior ink ejection or damage to the head, thereby providing always good image quality.

The above and other objects, effects, features and advantages of the present invention will become more apparent from the following description of embodiments thereof taken in conjunction with the accompanying drawings.

BRIEF DESCRIPTION OF THE DRAWINGS

FIG. 5 is a flow chart showing the relationship of FIGS. 5A and 5B;

DETAILED DESCRIPTION OF PREFERRED EMBODIMENTS

In the following, embodiments of the present invention will be described with reference to the drawings.

(Entire Construction)

Figure 1:
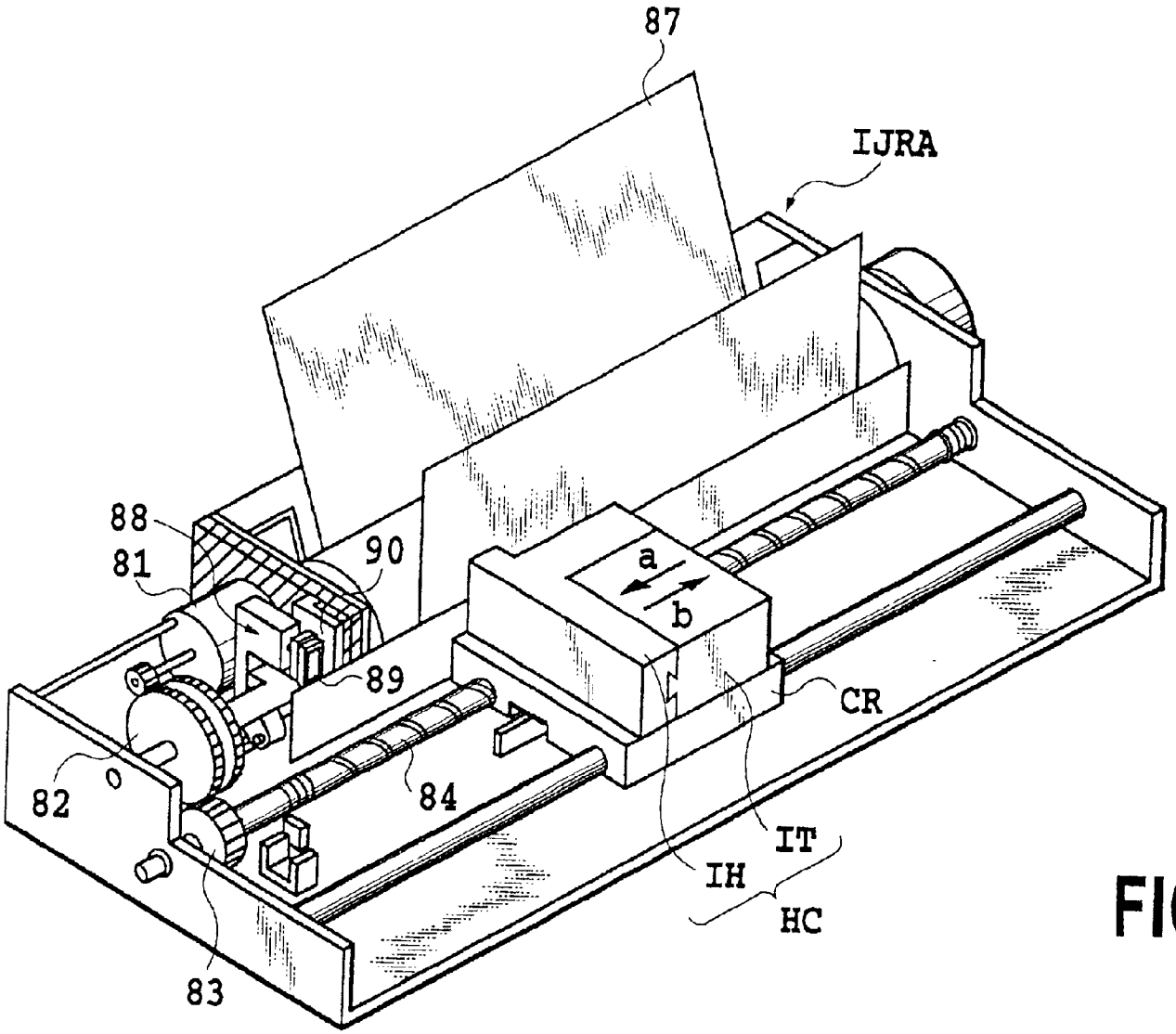
FIG. 1 is a perspective diagram showing a construction example of the ink jet print apparatus to which the present invention is applied.

FIG. 1 is a schematic diagram of an ink jet print apparatus IJRA to which the present invention is applied.

In the figure, a lead screw 84 is rotated in forward and reverse directions by forward and reverse rotation of a drive motor 81 through drive force transmission gears 82 and 83. A carriage CR has a pin (not shown) engaging with a spiral groove of the lead screw 84, and is reciprocally moved in the direction of the arrows a and b in the figure according to the rotational direction of the lead screw 84. On the carriage CR, a head cartridge HC comprising an ink jet print head IH and an ink tank IT is mounted. The ink jet print apparatus IJRA shown in FIG. 1 is a printing apparatus in general called a serial printer which performs print operation to the entire surface of a print sheet 87 by repeating primary scanning along the arrows a and b of the carriage CR and secondary scanning of the print sheet 87 as a printing medium.

At the left end side of the movable area of the carriage CR, a suction recovery unit 88 is provided opposing each ejection opening of the print head IH on the carriage CR. The suction recovery unit 88 is provided with a cap member 89 for capping the face of the print head IH, a wiper blade 90 for wiping the face of the print head IH, and a pump (not shown) for sucking ink from each nozzle through an ink passage from the cap. By this suction recovery unit 88, suction recovery operation is performed for maintaining ink ejection condition of the print head IH in good condition.

(Print Head)

Figure 2:
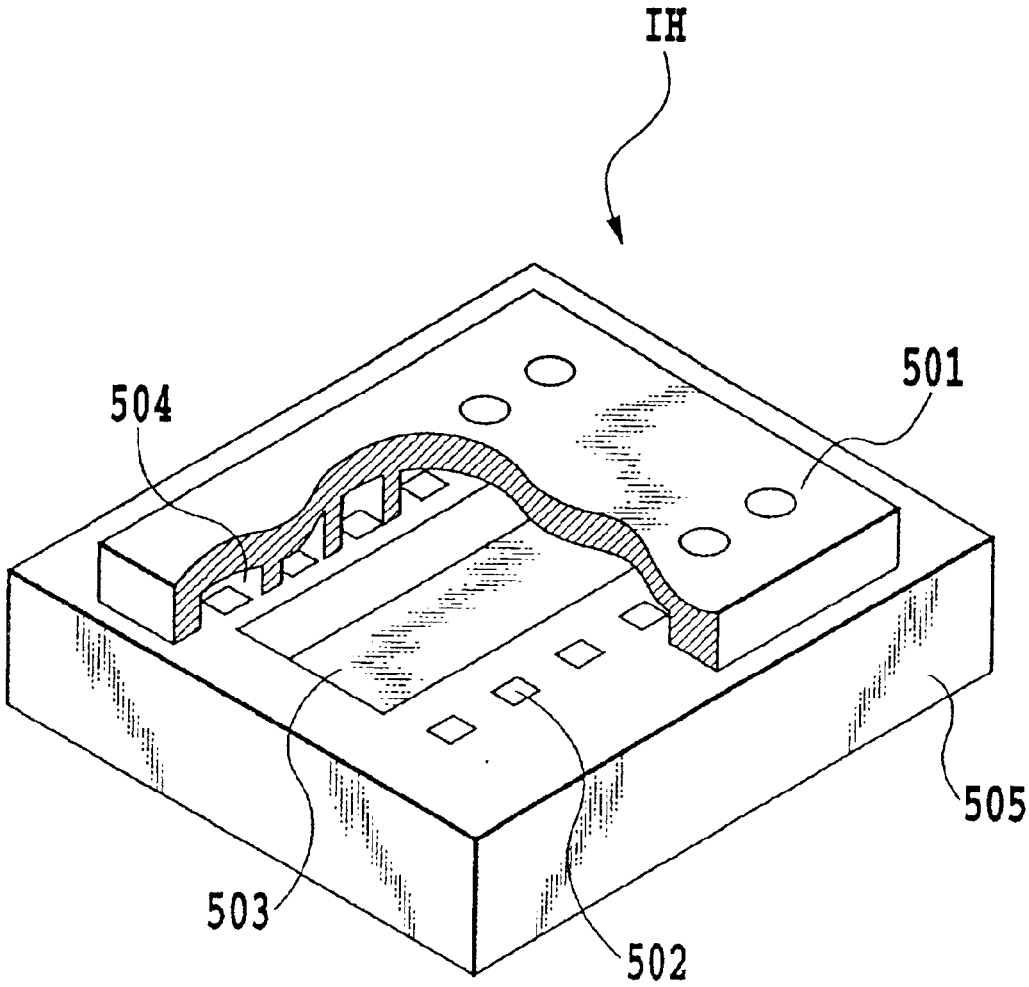
FIG. 2 is a schematic perspective diagram showing conceptive construction of an ink jet print head.

FIG. 2 shows a construction example of the ink jet print head IH. In this figure, a so-called side-shooter type head structure is shown, in which the ink ejection direction is the perpendicular direction to the heater surface (the opposite direction to the heat surface) of the heat generation element. Of course, the present invention can also be applied to a so-called edge-shooter type head in which the ink ejection direction is parallel to the heater surface.

In the side-shooter type ink jet print head IH shown in FIG. 2, a plurality of ink ejection openings 501 are disposed in a staggered pattern on both sides of an ink supply port 503. An electrothermal transducer (print element) 502 for generating thermal energy for ejecting ink from each ink ejection opening 501 is provided on a substrate 505 for each ink flow passage 504. Each electrothermal transducer 502 mainly comprises a heat generation resistor element and electrode wiring for supplying power to the heat generation resistor element and a protective film for protecting these components from ink.

The ink supply port 503 is generally formed by dicing, sand blasting, anisotropic etching and the like, and FIG. 2 shows an ink supply port 503 formed by anisotropic etching which is high in machining precision. If the ink supply port is low in machining precision, since, in respective ink flow passages 504, the distance from the end of the ink supply port to the heat generation resistor element differs, a variation occurs in the flow resistance, resulting in a change in ejection amount of ink ejected from respective ejection openings 501, which deteriorates the quality of printed image. For this reason, machining precision of the ink supply port 503 is an important factor.

As a method for forming the ink ejection opening 501, there is a method in which a film such as polyimide previously processed by laser processing is adhered onto the substrate 505, or a method in which a resin material is coated on the substrate 505, exposed and developed using a photolithographic technique or formed by plasma etching. However, in view of increasing requirements to recent photo printing, hereafter requirement for landing accuracy of ink droplets will be even further stricter. Therefore, from the point of view of machining precision of the ejection opening 501 and position accuracy with the heat generation resistor element 502, the formation method on the substrate 505 using photolithographic techniques is advantageous.

In the side-shooter type ink jet print head IH of the above-described construction, the ink forms a meniscus and is held in the vicinity of a plurality of ink ejection openings 501. At this time, by selectively driving a plurality of heat generation resistor elements 502 according to image print information and the like, the ink on the heating surface of the heat generation resistor element is rapidly heated and boiled to generate a bubble, and the ink is ejected by a pressure of the bubble.

(Control System)

Figure 3:
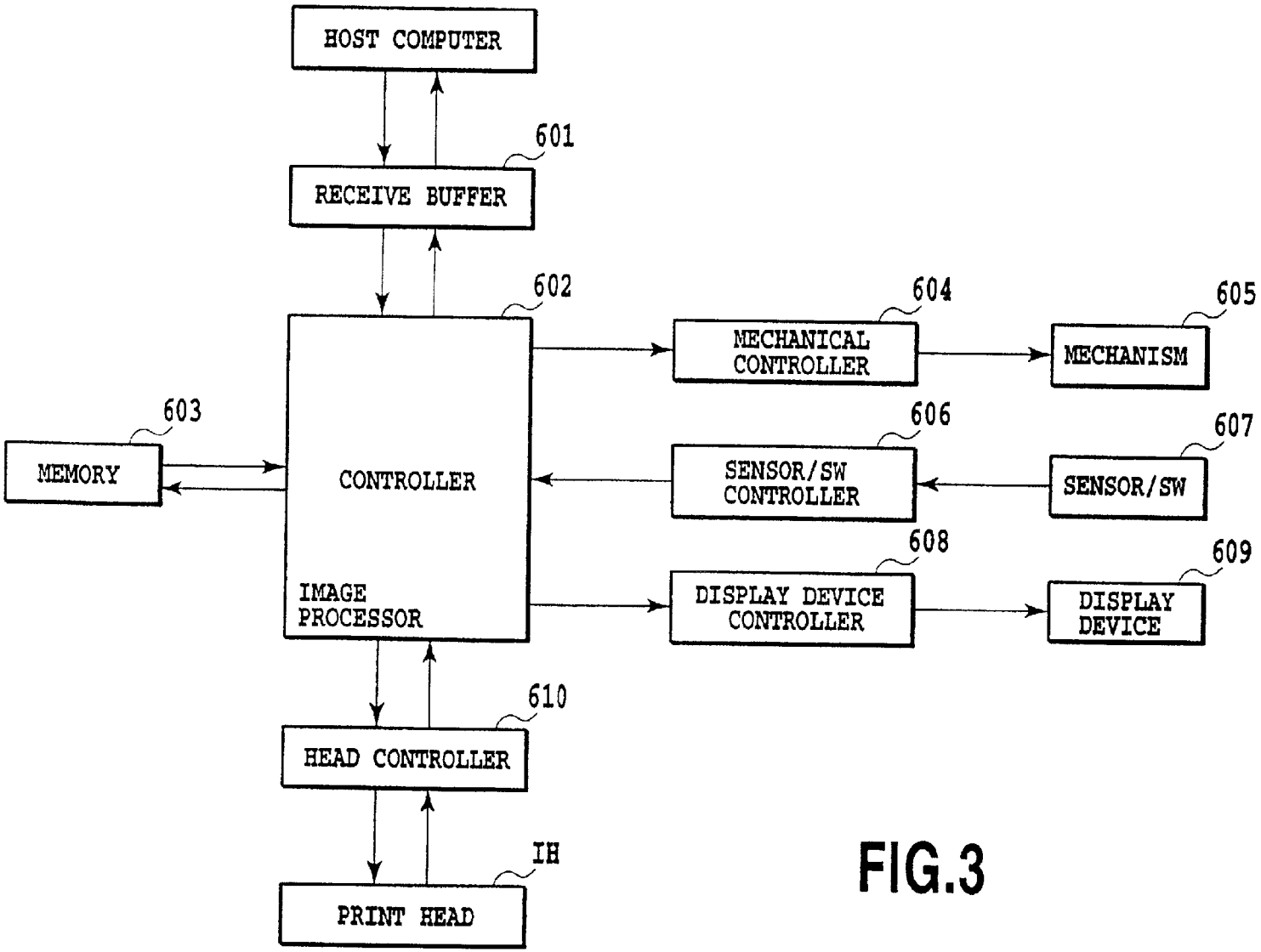
FIG. 3 is a block diagram showing a construction example of control system of the ink jet print apparatus.

FIG. 3 shows a block diagram of a control system used in an ink jet print apparatus equipped with the above-described ink jet print head.

In FIG. 3, character or image data (hereinafter referred to as image data) to be recorded is inputted from the host computer to the receiving buffer 601 of the ink jet print apparatus. Further, data for confirming whether the data is transferred correctly, or data for notifying operation condition of the ink jet print apparatus is outputted from the ink jet print apparatus to the host computer. Data of the receiving buffer 601, under the control of a controller (CPU) 602, is transferred to a memory 603 and temporarily stored in a RAM (random access memory).

A mechanical controller 604, by an instruction from the CPU 602, drives a mechanism (mechanical part) 605 such as a carriage motor 81 or line feed motor or the like. A sensor/SW controller 606 transmits signals from a sensor/SW 607 comprising various sensors and SW (switch). A display device controller 608 controls LEDs of a display panel group and a display device 609 comprising liquid crystal display devices and the like by instructions from the CPU 602. A print head controller 610 drives and controls the print head IH by instructions from the CPU 602 and detects temperature information and the like showing conditions of the print head IH and transmits these to the CPU 602.

Figure 4:
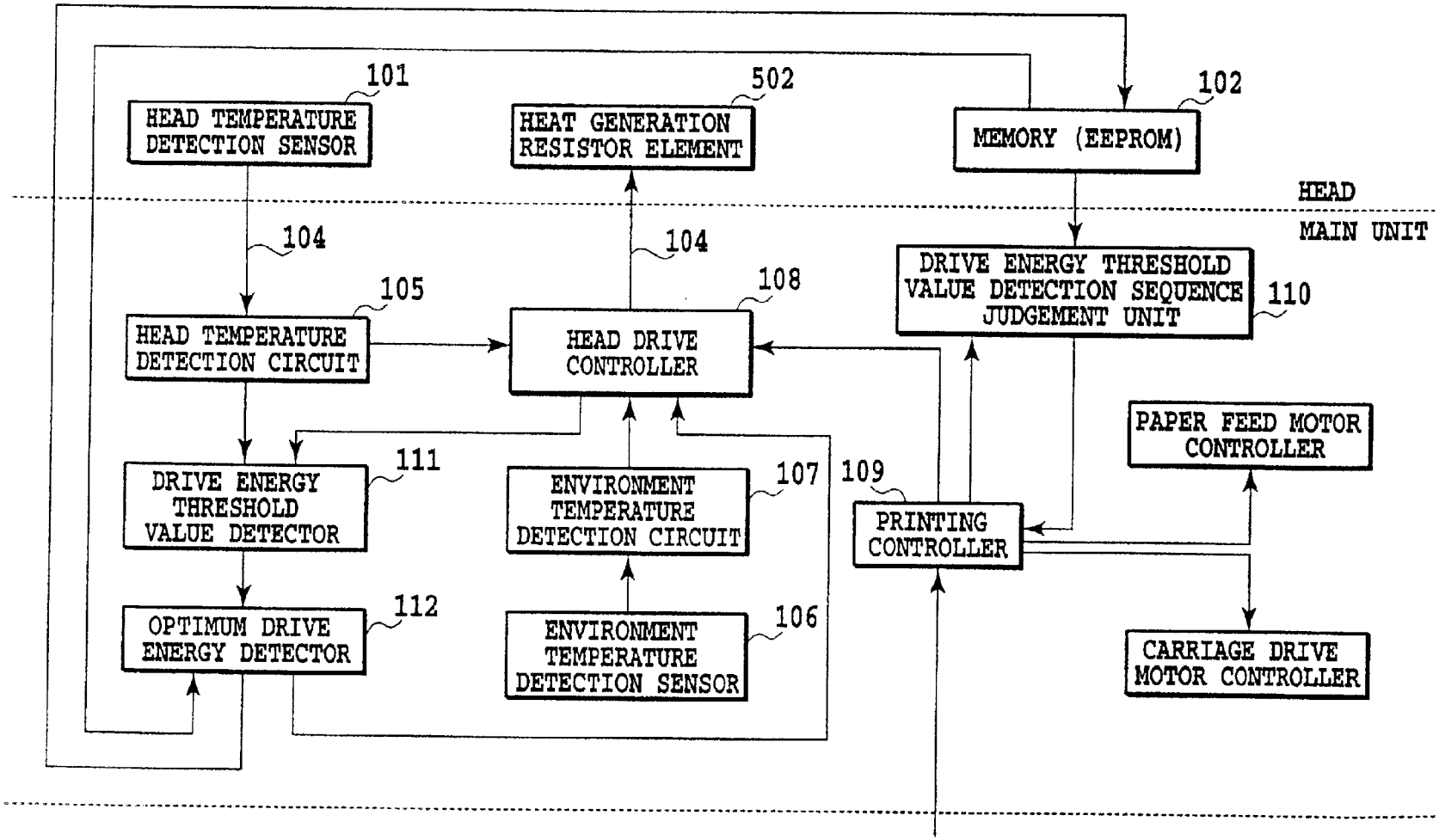
FIG. 4 is a block diagram showing a construction example of control system of the ink jet print apparatus according to the present invention.

FIG. 4 shows a block diagram of the control system according to the present invention for detecting a temperature increase difference of the ink jet print head generated by a difference whether or not ink droplets are ejected from the above-described respective ink ejection openings 501.

Inside the ink jet print head IH, as described above, a heat generation resistor element 502 for ejecting ink, and a heater board (device board) which is a Si substrate integrated with electrical circuit and drive element for controlling the heat generation resistor element are disposed. On the heater board, a head temperature detection sensor 101 for detecting temperature of the print head IH is disposed. In the present embodiment, as the head temperature detection sensor 101, one which utilizes temperature characteristic of output voltage of a diode to perform temperature detection is used, however, one which uses temperature characteristic of electrical resistance of a resistor or other types can also be used.

Further, at the print head IH side, a memory 102 is provided for storing information (initial optimum drive condition data (drive energy, drive voltage, drive pulse width and the like), various correction data, or operation history data of the head) used for determining drive energy applied when the main unit of the print apparatus drives respective heat generation resistor elements 502 of the print head IH. As the memory 102, other than EEPROM (electrical erasable programmable ROM), a fuse ROM, a rank resistor formed by the same process as the heat generation resistor element 502 and the like can also be used. However, when a fuse ROM or rank resistor is used, since it is impossible to rewrite information of the memory 102, in such a case, when the optimum drive condition changes and information related thereto is stored, the memory at the main unit of the print apparatus side is utilized.

Detection temperature data of the head temperature detection sensor 101 is inputted to a head temperature detection circuit 105 at the main unit side of the print apparatus through a signal line (flexible wiring) 104.

At the main unit side of the print apparatus, the head temperature detection circuit 105 comprises a detection circuit for receiving an output signal from the head temperature detection sensor 101, an A/D transducer circuit for converting the output signal to a digital data, a circuit for converting and correcting A/D conversion data to a type adaptable to the control. Output from the head temperature detection circuit 105 is treated as a signal designating a head temperature, and is used for various controls such as head drive pulse PWM control (pulse width modulation control for head temperature) and the like.

A head environment temperature sensor 106 is to detect an ambient temperature of the print head IH, which uses, for example, a thermistor or the like provided on the substrate disposed on the carriage HC equipped with the head IH. The environment temperature detection circuit 107, similar to the head temperature detection circuit 105, comprises a circuit for detecting output of the thermistor, an A/D transducer circuit, a correction/conversion circuit and the like. Output from the environment temperature detection circuit 107 is treated as a signal designating an environment temperature which is used for performing temperature keeping control according to a change of environment temperature.

A head drive controller 108, on the basis of the head temperature detection value from the head temperature detection circuit 105, environment temperature detection value from the environment temperature detection circuit 107, information from the printing controller 109, determines drive condition of the heat generation resistor elements 502 in the print head IH to generate drive signals, and performs the above-described head temperature keeping control.

In the printing controller 109, according to the conditions such as print data from the host computer or print mode set by the user on the panel or the like, control is performed such as determining actually which nozzle is driven at which timing to eject ink and accordingly determining drive timing and drive amount of a drive motor 81 driving the carriage CR or a paper feed motor and the like.

In a drive energy threshold value detection sequence judgment unit 110, from information such as operation history data stored in the memory 102 of the print head IH or drive pulse number data from the printing controller 109, a judgment is performed as to whether or not drive energy threshold value detection sequence is performed. For example, when the number of ink ejections from the ink ejection opening exceeds a predetermined value, or when the number of printed characters exceeds a predetermined number, performing the drive energy threshold value detection sequence is automatically determined. Here, if selection is made for performing the drive energy threshold value detection sequence, the determination is transmitted to the printing controller 109 and various sequence operations are started by signals from the controller.

A drive energy threshold value detector 111, when the above sequence is started, successively receives sequentially decreasing drive energy information from the head drive controller 108 and corresponding head temperature information from the head temperature detection circuit 105, and judges a drive energy threshold value according to this information.

In an optimum drive energy detector 112, an optimum drive condition is determined using the threshold data judged by the drive energy threshold value detector 111, and the optimum drive condition is reflected to the head drive controller 108 and the memory 102 of the print head IH. That is, the previous drive condition data recorded in the memory 102 is compared with the newly determined drive condition data, when both are different, the previous data is updated with the data of this time.

(First Embodiment)

Figure 5A:
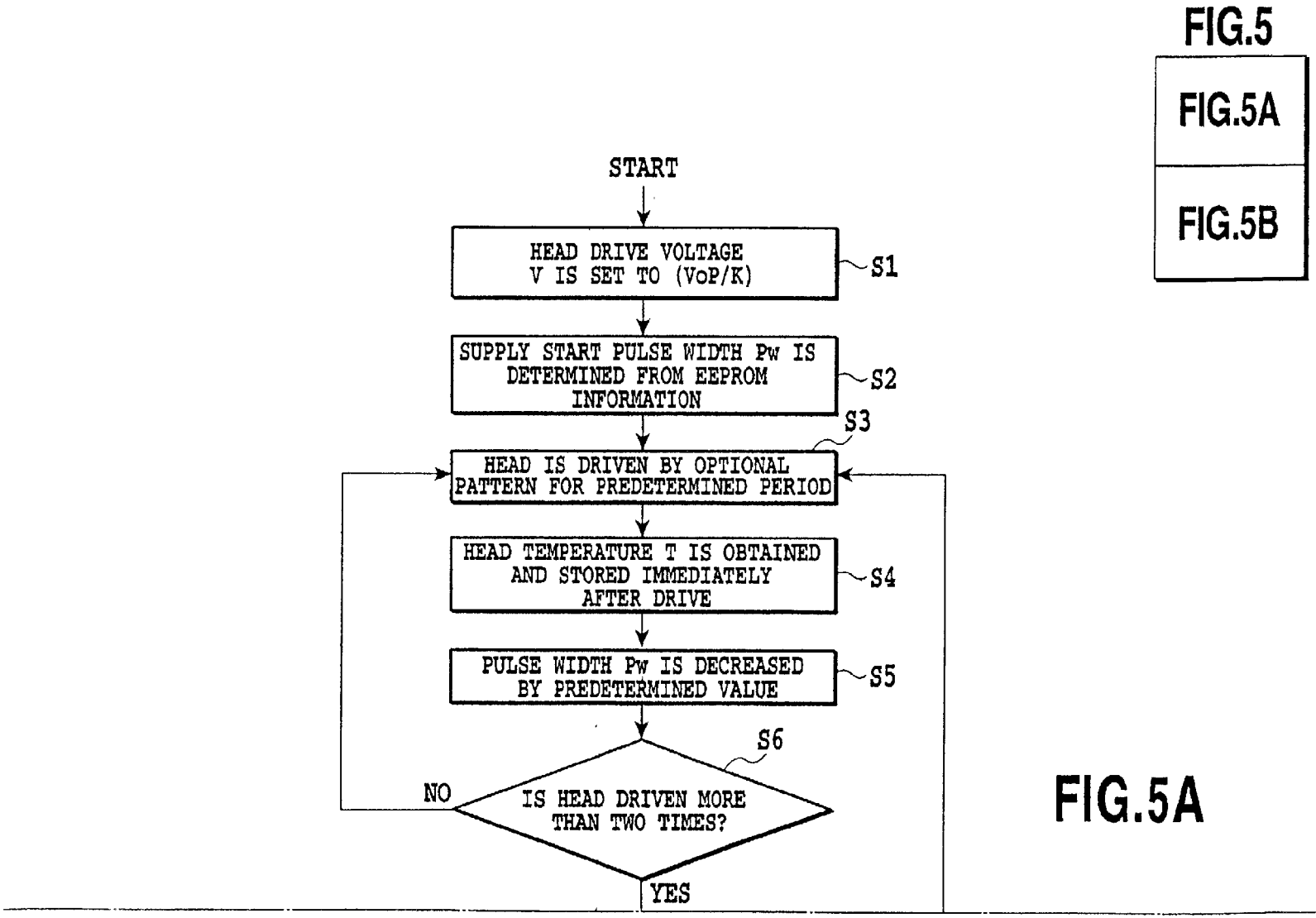
FIGS. 5A and 5B are flow charts showing the operation procedure of a first embodiment of the present invention.
Figure 5B:
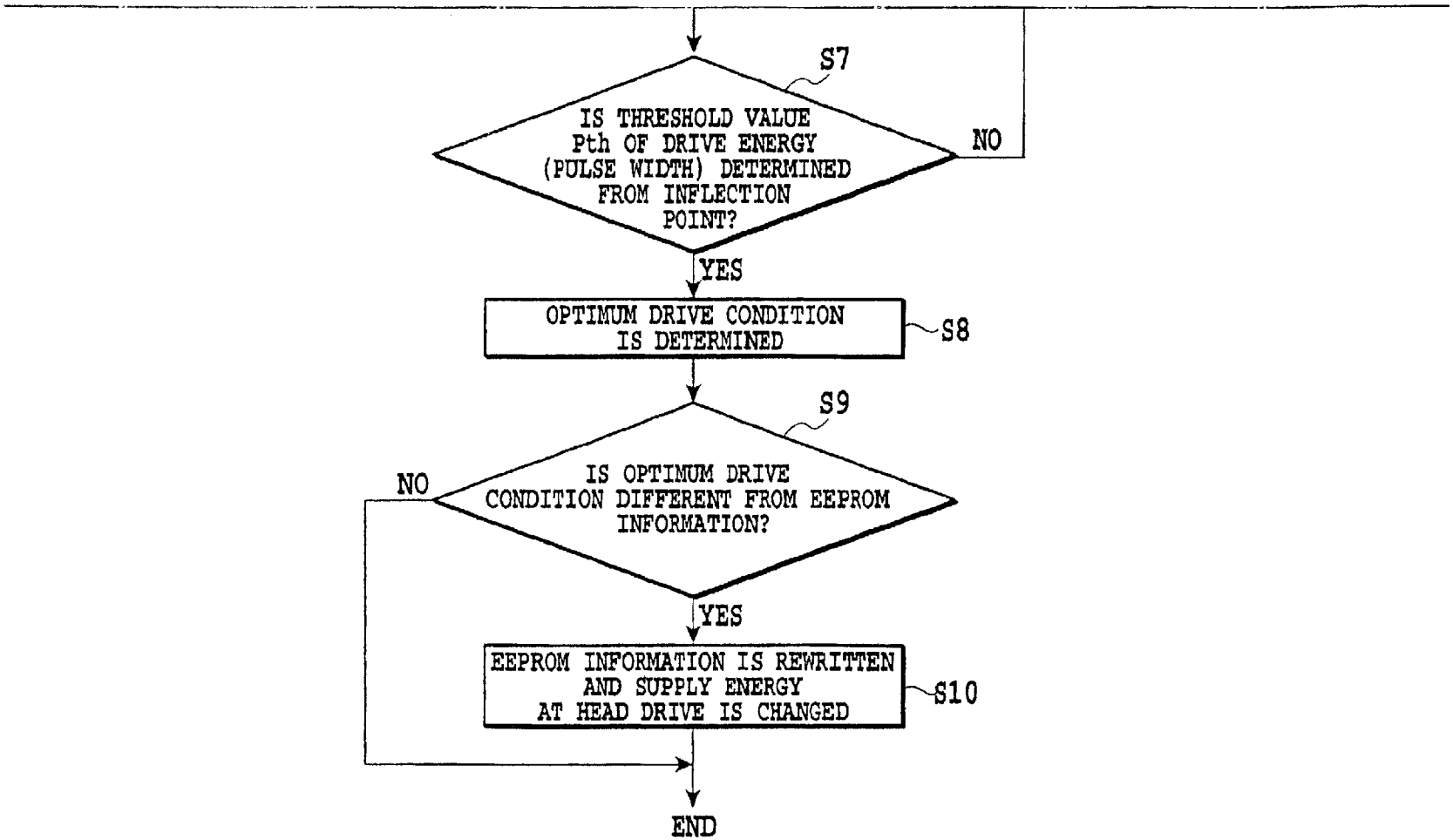

FIGS. 5A and 5B show a first embodiment related to basic operation procedures of drive energy threshold value detection sequence.

The memory 102 of the print head IH, as described above, stores a voltage (K·Vth), based on a previously measured ink ejection threshold voltage Vth multiplied by a predetermined margin value K, as an optimum head drive voltage Vop. Therefore, in the head drive controller 108, when each heat generation resistor element 502 of the print head IH is driven, the optimum head drive voltage Vop is read from the memory 102, and the actual drive voltage is determined according to the voltage value Vop.

In the first embodiment, each heat generation resistor element 502 of the print head IH is supplied with sequentially decreasing drive energy and head temperature corresponding to each drive energy is measured. In this case, in this first embodiment, the head drive voltage V is fixed and pulse width Pw of drive pulse signal applied to the heat generation resistor element 502 is varied (gradually shortened). As the above fixed drive voltage, the optimum head drive voltage Vop stored in the memory 102 of the print head IH divided by the margin value K (Vop/K) is used. In this case, since the voltage is fixed and the pulse width is varied, the drive energy is varied depending on the pulse width.

When the drive energy threshold value detection sequence is started, the head drive voltage V is fixedly set to (Vop/K) (step S1).

Next, a measurement start value of the pulse width Pw is determined according to the stored information of the memory 102 of the print head IH (step 2). As the measurement start value, a slightly higher value is adopted so that ink ejection is surely performed.

When the supply start pulse width Pw is determined, using the determined pulse width Pw and the above head drive voltage V, the print head is driven for a certain period of time by a preset drive pattern (normally all heat generation resistor elements are driven, however, if it is possible to surely detect the head temperature changes, selected part of heat generation resistor elements may be driven) (step S3). Here, the predetermined drive pattern and the certain period of time are determined by the nozzles used, drive frequency, number of drive pulses and the like.

Immediately after the completion of head drive for the certain period of time, a head temperature T detected by the head temperature detection sensor 101 is obtained (step S4). The obtained head temperature T is corresponded to the pulse width Pw at that time, and the obtained head temperature T and the pulse width Pw are stored in the drive energy threshold value detector 111.

Next, the pulse Pw is subtracted by a predetermined value (a pulse width variable resolution part possessed by the head drive circuit), the print head is driven again by the same drive pattern as the previous time for a certain period of time to obtain the head temperature T similarly (steps S6 to S4). The obtained head temperature T is also corresponded to the pulse width Pw at that time, and the obtained head temperature T and the pulse width Pw are stored in the drive energy threshold value detector 111.

These series of processings are repeatedly performed to obtain a threshold pulse width Pth for determining presence of ink ejection (step S7).

The threshold pulse width Pth is obtained by finding an inflection point or a minimum temperature value or the like from data showing the correspondence relationship between the stored pulse width Pw and the head temperature T.

Figure 6:
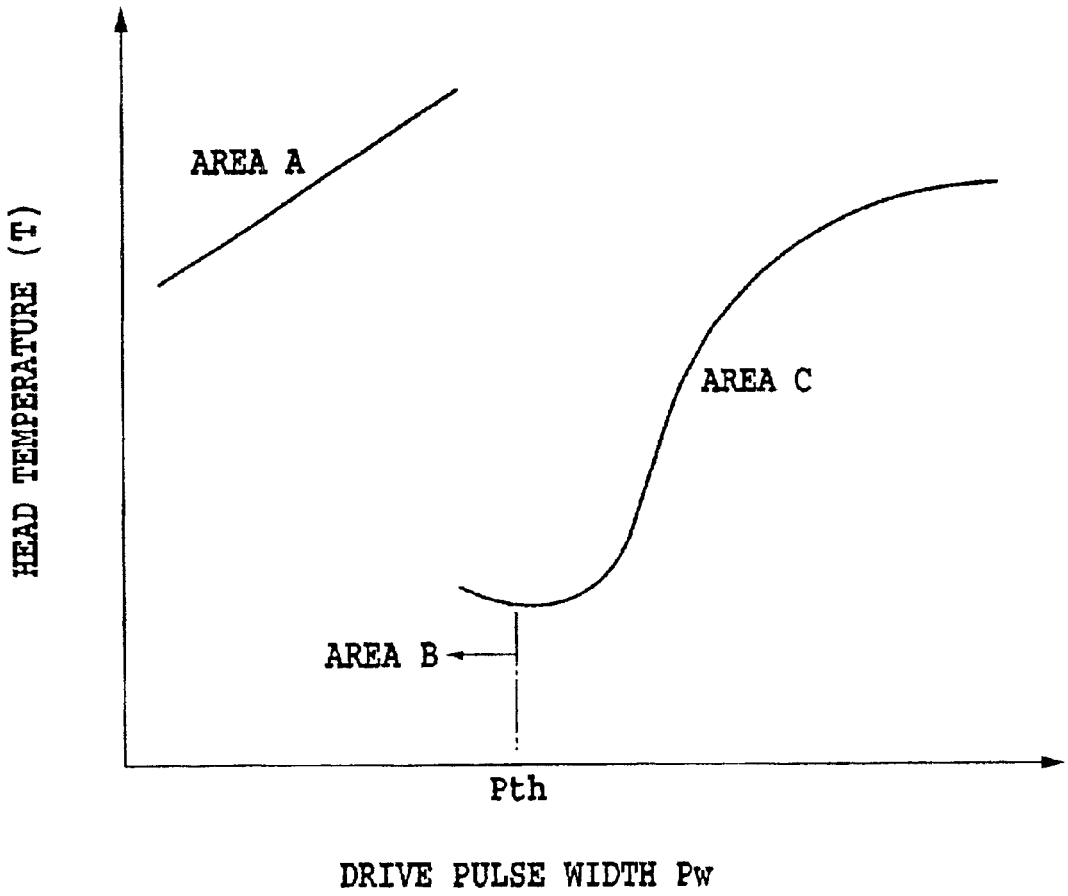
FIG. 6 is a graph showing head temperature and pulse width of drive pulse signal.

For example, FIG. 6 shows the correspondence relationship between the head temperature T and the pulse width Pw (drive energy E) stored in the drive energy threshold value detector 111, in the figure the boundary between area B and area C is a threshold value Pth of the pulse width Pw.

In this case, in area B, the head temperature T increases with decreasing pulse width Pw; this is considered as due to the fact that ejection/non-ejection is mixing because of variation of the plurality of nozzles.

Further, in area C, an excess of energy is supplied to the print head in addition to the energy required for ejection of ink as the pulse width Pw increases, which generates a rapid increase of head temperature.

On the other hand, in area A in the figure, since the ink is not ejected due to energy shortage, and heat dissipation from the head by the ejected ink is not made, the supplied energy solely contributes to an increase of head temperature, resulting in regular increase of head temperature.

As shown in FIG. 6, since head temperature increase pattern is considerably different between the case of ink ejection and the case of non-ejection, in the drive energy threshold value detector 111, by analyzing data pattern showing the correspondence relationship between the stored pulse width Pw and head temperature T, the threshold value Pth of drive pulse can be determined.

In the present embodiment, since voltage Vop/K, which is the optimum drive voltage Vop divided by the margin value K, is used at the time of measurement, the above calculated pulse width threshold value Pth can be used, as is, as the optimum value Pop. Of course, Vop becomes the optimum drive voltage.

The optimum drive energy detector 112 determines the optimum drive pulse width Pop as described above (step S8), the obtained optimum drive pulse width Pop is compared with the drive pulse width in the drive condition data stored in the memory 102 of the print head IH (step S9). When these are different, the obtained optimum drive pulse width Pop is reflected to the memory 102 of the print head IH and the head drive controller 108, so that stored information of the memory 102 is updated with the new data Pop and a setting change of drive condition of the head drive controller 108 is performed (step S10).

However, as described above, when a non-rewritable memory device such as a fuse ROM or the rank resistor or the like is used as the memory 102, the memory 102 is not rewritten, but only the drive condition setting change of the head drive controller 108 is performed.

As to the position of the print head IH when these series of processings are carried out, to prevent contamination of the print apparatus by ink ejection, it is preferable that the operation be performed at the recovery position provided with the suction recovery unit 88 or at a preliminary ejection position (not shown) for preliminary ejection.

Further, when the recovery processing is added every time after obtaining the head temperature in order to repeatedly obtain the head temperature T corresponding to the pulse width Pw, since the head temperature T rapidly returns to the initial condition compared to the case of allowance, a time-up of sequence can be achieved.

(Second Embodiment)

Figures 7, 7A, 7B:
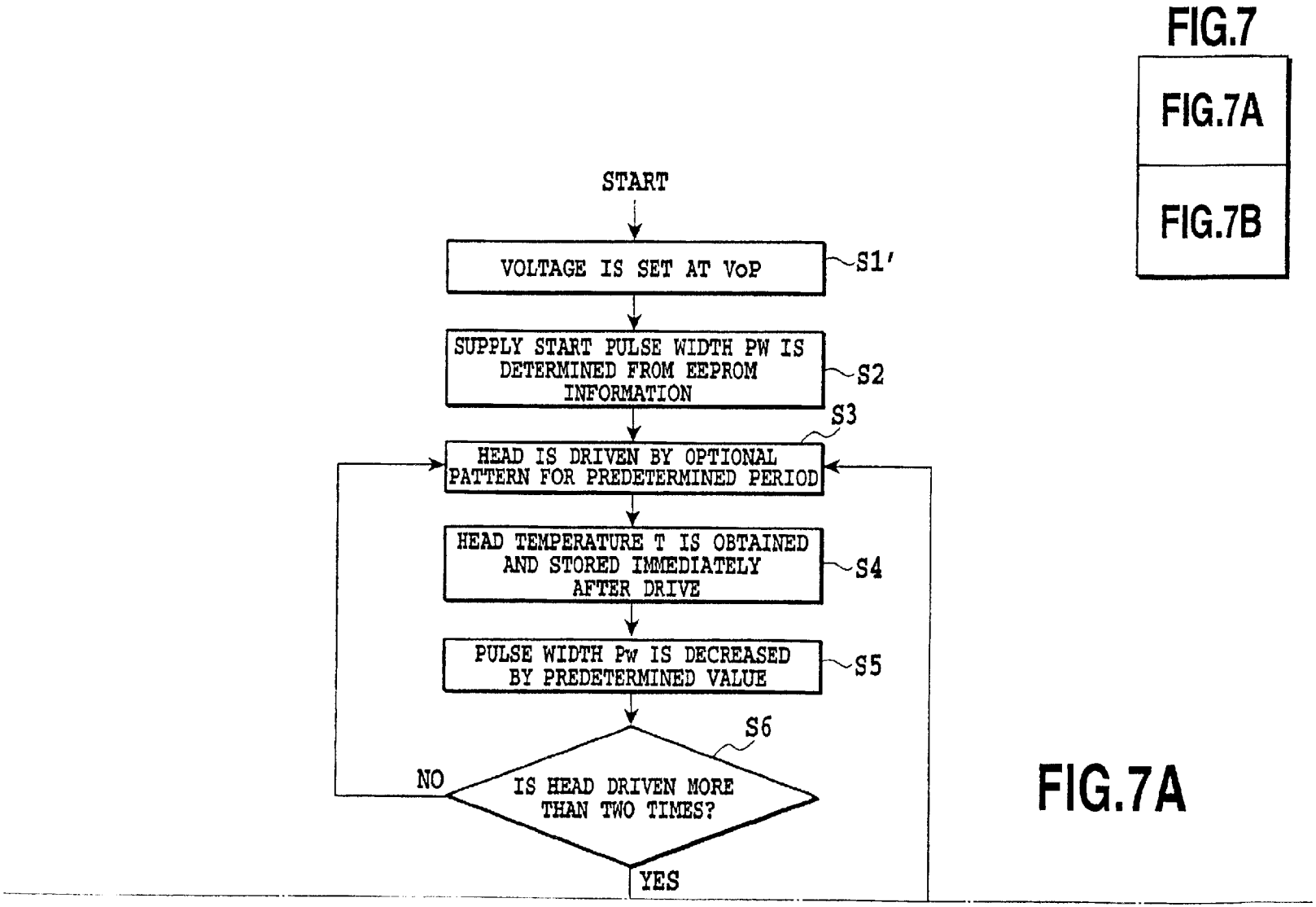
FIG. 7 is a flow chart showing the relationship of FIGS. 7A and 7B.
FIGS. 7A and 7B are flow charts showing the operation procedure of a second embodiment of the present invention.
Figure 7B:
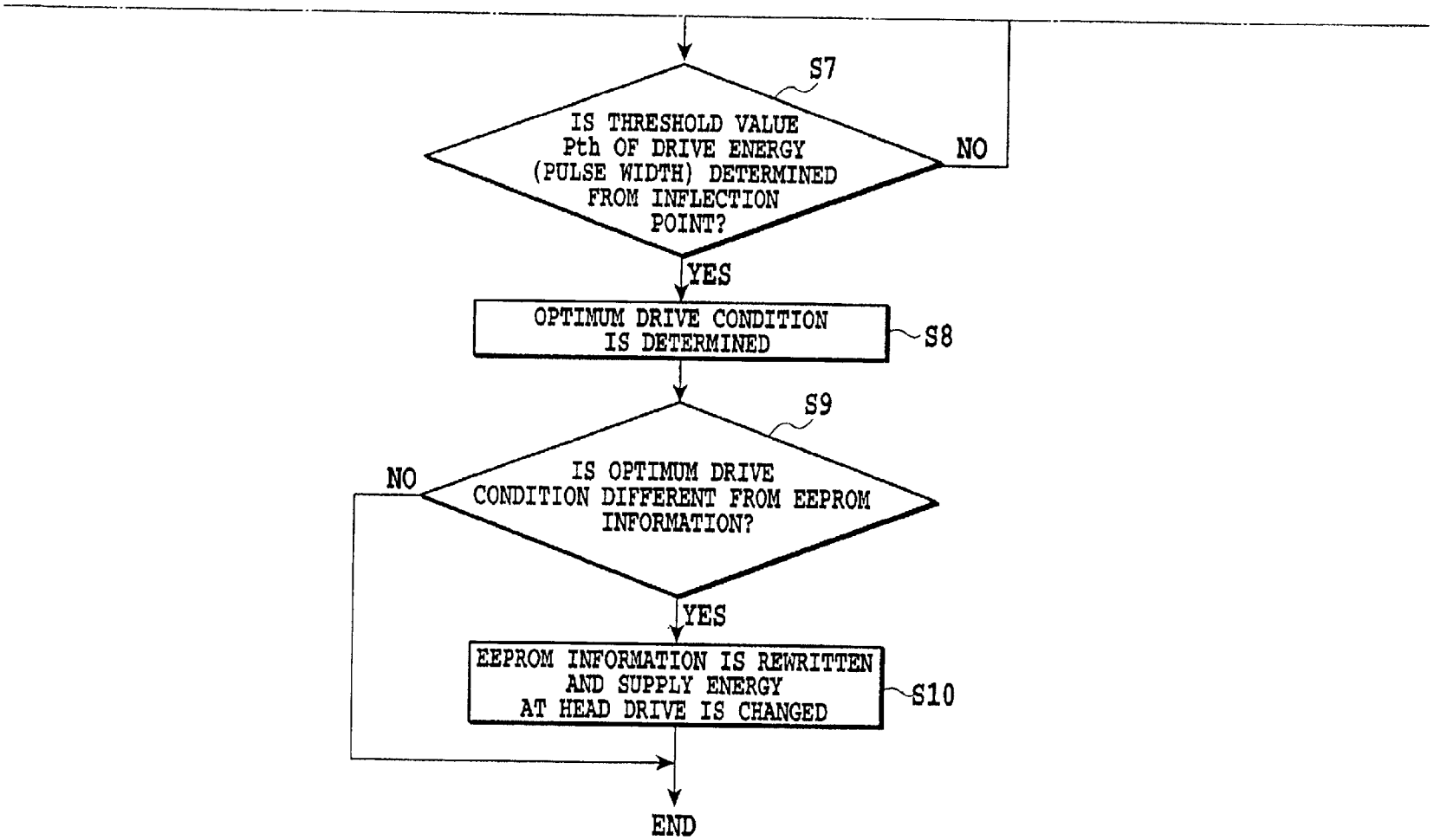

FIGS. 7A and 7B show a second embodiment of the present invention.

In this second embodiment, during print head drive performed in the drive energy threshold value detection sequence, the head drive voltage Vop multiplied by the margin value K stored in the memory 102 is used, as is, as a fixed voltage (step S1').

In FIGS. 7A and 7B, other steps S2 to S10 are the same as in the above first embodiment, and the same description is omitted. That is, also in the second embodiment, the head drive energy is successively varied by successively varying the pulse width Pw, the head temperature T is detected at every drive, a threshold value Pth of the drive pulse is obtained from the relationship between the obtained head temperature T and drive pulse width Pw, further from this threshold value Pth, an optimum drive condition is obtained. When the obtained drive condition differs from the drive condition data stored in the memory 102, stored information of the memory 102 is rewritten and setting of drive condition of the head drive controller 108 is changed.

Since, in this case, the optimum drive voltage Vop is used, as is, at the time of measurement, the above calculated pulse width threshold value Pth multiplied by $K^2$ (since the pulse width is in a relation of square root of the voltage) is used as the optimum value Pop. Of course, also in this case, Vop becomes the optimum drive voltage.

In this second embodiment, since the head drive voltage Vop is not changed, the print apparatus does not require drive voltage changing means or a drive voltage of separate system, load to the print apparatus is small.

In the above embodiment, the drive voltage is fixed and the pulse width of the drive pulse signal is varied to make the drive energy supplied to the print head variable, however, alternatively, the pulse width may be fixed and the drive voltage be varied.

Further, in the above embodiment, the drive pulse width is gradually decreased, however, on the contrary, the drive pulse width may be gradually increased.

(Others)

Incidentally, the present invention achieves distinct effect when applied to a print head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type inkjet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consist of a plurality of print heads combined together, or one integrally arranged print head.

In addition, the present invention can be applied to various serial type print heads: a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can be also changed. For example, only one print head corresponding to a single color ink, or a plurality of print heads corresponding to a plurality of inks different in color or concentration can be used. In other words, the present invention can be effectively applied to an apparatus having at least one of the monochromatic, multicolor and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the inkjet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through-holes formed in a porous sheet as liquid or solid substances so that th ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, with the present invention, since the optimum drive energy is continuously supplied over the service life of the ink jet print head, inferior ink ejection or damage to the head can be prevented, thereby providing always good image quality. Further, since the optimum drive energy is determined from the temperature increase difference of ink jet print head generated from the difference between ejection and non-ejection of ink, complicated means such as printed matter judgment by a scanner or ejection observation by a laser is not specifically required, thereby preventing a size increase of the print apparatus or a cost increase. Still further, troublesome adjustment by the user is not necessary.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method for controlling the drive energy of an ink jet print apparatus wherein a print element is driven to eject an ink from an ink jet print head to a printing medium for performing printing, the method comprising:

a first step for supplying a plurality of various drive energies for carrying out one ejecting operation successively to ink jet print head;

a second step for monitoring temperature of the ink jet print head in each supply of the plurality of various drive energies for carrying out one ejecting operation, the temperature reflecting a temperature change caused by each supplied drive energy;

a third step for judging a threshold drive energy between a condition where an ink ejection of the ink jet print head was induced and a condition where the ink ejection of the ink jet print head was not induced using a value for each supplied drive energy and a value for each monitored temperature;

a fourth step for determining a drive condition for ejecting ink on the basis of the threshold drive energy; and a fifth step for driving the print element on the basis of the determined drive condition.

2. A method for controlling the drive energy of an ink jet print apparatus according to claim 1, wherein in said first step, a difference in the amount of each drive energy supplied to the ink jet print head is generated by changing a pulse width of a drive pulse signal applied to the print element.

3. A method for controlling the drive energy of an ink jet print apparatus according to claim 1, wherein in said first step, an initial drive energy supplied is determined on the basis of drive condition information stored in the ink jet print head.

4. A method for controlling the drive energy of an ink jet print apparatus according to claim 1, wherein in said fifth step, the determined drive condition is compared with drive condition information stored in the ink jet print head, and when both are different, the drive energy to drive the print element is changed.

5. A method for controlling the drive energy of an ink jet print apparatus according to claim 1, wherein in said fifth step, when the determined drive condition is different from drive condition information stored in the ink jet print head, the drive condition information stored in the ink jet print head is updated with the determined drive condition data.

6. A method for controlling the drive energy of an ink jet print apparatus according to claim 1, wherein energy supply to the ink jet print head is made by applying drive signals to heat generation elements of the ink jet print head.

7. A method for controlling the drive energy of an ink jet print apparatus wherein a print element is driven to eject an ink from an ink jet print head to a printing medium for performing printing, the method comprising:

a first step for supplying a plurality of various drive energies for carrying out one ejecting operation successively to the ink jet print head;

a second step for monitoring temperature of the ink jet print head in each supply of the plurality of various drive energies for carrying out one ejecting operation, the temperature reflecting a temperature change caused by each supplied drive energy;

a third step for determining a threshold drive condition between a condition where an ink ejection of the ink jet print head was induced and a condition where the ink ejection of the ink jet print head was not induced using a value for each supplied drive energy and a value for each monitored temperature; and a fourth step for driving the print element on the basis of the determined drive condition.

8. An ink jet print apparatus wherein a print element is driven to eject an ink from an ink jet print head for performing printing, the ink jet print apparatus comprising:

first means for supplying a plurality of various drive energies for carrying out one ejecting operation successively to the ink jet print head;

second means for monitoring temperature of the ink jet print head in each supply of the plurality of various drive energies for carrying out one ejecting operation, the temperature reflecting a temperature change caused by each supplied drive energy;

third means for judging a threshold drive energy between a condition where an ink ejection of the ink jet print head was induced and a condition where the ink ejection of the ink jet print head was not induced using a value for each supplied drive energy and a value for each monitored temperature;

fourth means for determining a drive condition for ejecting ink on the basis of the threshold drive energy; and fifth means for changing the drive energy applied to the print element of the ink jet print head on the basis of the determined drive condition.

9. An ink jet print apparatus according to claim 8, wherein a change in each drive energy supplied to the ink jet print head is performed by changing a pulse width of a drive pulse signal applied to the print element.

10. An ink jet print apparatus according to claim 8, wherein an initial drive energy supplied by said first means is determined on the basis of drive condition information stored in the ink jet print head.

11. An ink jet print apparatus according to claim 8, wherein said fifth means compares the determined drive condition with drive condition information stored in the ink jet print head, and when both are different, changes the drive energy to drive the print element.

12. An ink jet print apparatus according to claim 8, wherein said fifth means, when the determined drive condition is different from drive condition information stored in the ink jet print head, updates the drive condition information stored in the ink jet print head with the determined drive condition data.

13. An ink jet print apparatus according to claim 8, wherein energy supply to the ink jet print head is made by applying drive signals to heat generation elements of the ink jet print head.

14. An ink jet print apparatus wherein a print element is driven to eject an ink from an ink jet print head for performing printing, the ink jet print apparatus comprising:

first means for supplying a plurality of various drive energies for carrying out one ejecting operation successively to the ink jet print head;

second means for monitoring temperature or the ink jet print head in each supply of the plurality of various drive energies for carrying out one ejecting operation, the temperature reflecting a temperature change caused by each supplied drive energy;

third means for determining a threshold drive condition between a condition where an ink ejection of the ink jet print head was induced and a condition where the ink ejection of the ink jet print head was not induced using a value for each supplied drive energy and a value for each monitored temperature; and fourth means for changing the drive energy applied to the print element of the ink jet print head on the basis of the determined drive condition.

15. An ink jet print apparatus wherein a memory for storing drive condition data is provided on an ink jet print head, by driving a print element an ink is ejected from the ink jet print head to a printing medium for performing printing, the ink jet print apparatus comprising:

first means for supplying a plurality of various drive energies for carrying out one ejecting operation successively to the ink jet print head;

second means for monitoring temperature of the ink jet print head in each supply of the plurality of various drive energies for carrying out one ejecting operation, the temperature reflecting a temperature change caused by each supplied drive energy;

third means for judging a threshold drive energy between a condition where an ink ejection of the ink jet print head was induced and a condition where the ink ejection of the ink jet print head was not induced using a value for each supplied drive energy and a value for each monitored temperature;

fourth means for determining a drive condition for ejecting ink on the basis of the threshold drive energy; and fifth means for comparing the determined drive condition with drive condition information stored in the ink jet print head and, when both are different, updating drive energy information stored in the memory of the ink jet print head with the determined drive condition data.

16. An ink jet print apparatus according to claim 15, wherein the memory provided on the ink jet print head is an EEPROM.

* * * * *